United States Patent [19]

Kennedy et al.

[11] Patent Number: 4,923,559

[45] Date of Patent: May 8, 1990

[54] APPARATUS FOR APPLYING TAPE TO PAVEMENT

[75] Inventors: Ronald R. Kennedy, Montoursville; Michael T. Manzitti, Williamsport; Frank E. Bennett; John F. Stout, both of Montgomery; Anthony M. Vellam, Cogan Station, all of Pa.

[73] Assignee: Linear Dynamics, Inc., Montgomery, Pa.

[21] Appl. No.: 235,439

[22] Filed: Aug. 23, 1988

[51] Int. Cl.[5] ..... E01C 23/16

[52] U.S. Cl. ..... 156/523; 156/577; 156/579; 404/94

[58] Field of Search ..... 156/523, 527, 579, 577, 156/71, 522; 404/94

[56] References Cited

U.S. PATENT DOCUMENTS

| | | | |
|---|---|---|---|
| 4,242,173 | 12/1980 | Stenemann | 156/523 |
| 4,317,696 | 3/1982 | Hutchinson et al. | 404/94 |
| 4,565,467 | 1/1986 | Eigenmann | 404/94 |
| 4,623,280 | 11/1986 | Stenemann | 404/94 |
| 4,824,516 | 4/1989 | Ishihara et al. | 404/94 |

*Primary Examiner*—Michael Wityshyn

*Attorney, Agent, or Firm*—Cushman, Darby & Cushman

[57] ABSTRACT

A tape applicator for selectively advancing one, two or more strips of tape from rolls mounted thereto and having a cutter assembly which can selectively cut one, two or more of the tape strips being applied. The tape advancement initiation device includes first and second rollers which are selectively brought into abutting engagement so as to grip a strip of tape depending therebetween and at least one of the rollers is selectively rotated to advance the tape gripped between the rollers. The rollers defining the tape advancement initiation device are preferably separated into at least first and second roller sections which are selectively independently rotatable to selectively independently advance select tape strips mounted to the apparatus. Similarly, the cutter assembly provided to cut the tape through foot pedal actuation is preferably divided into at least first and second sections which are independently selectively operable by respective foot pedal actuators so as to selectively independently cut a particular strip of tape being applied by the apparatus.

7 Claims, 5 Drawing Sheets

46
50
48
44
76
74
14
30
B
70
72
B
70
74
40
68
44
56
50
46
48
78
76
12
38b
38
38a
42

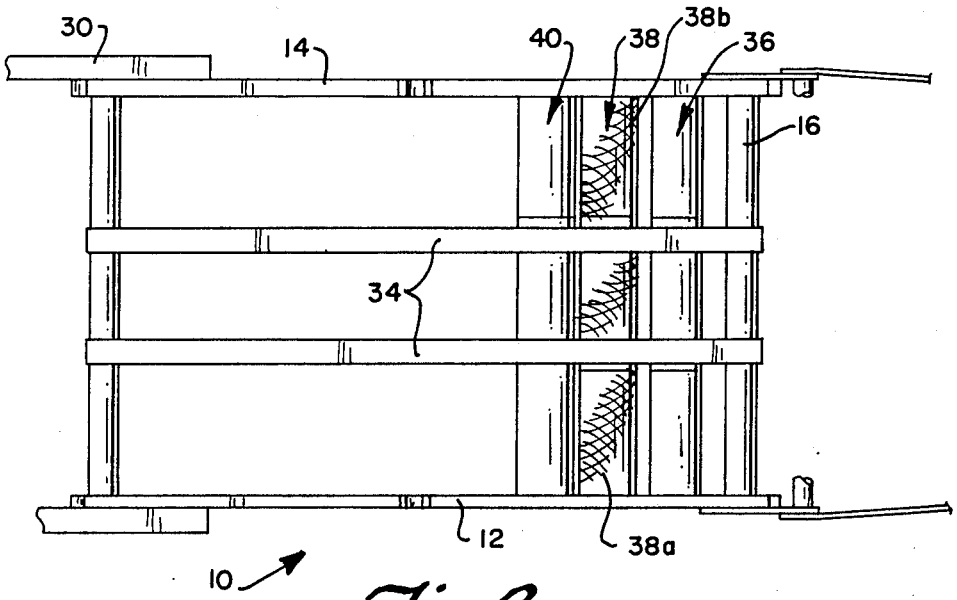
Fig. 3
Fig. 4
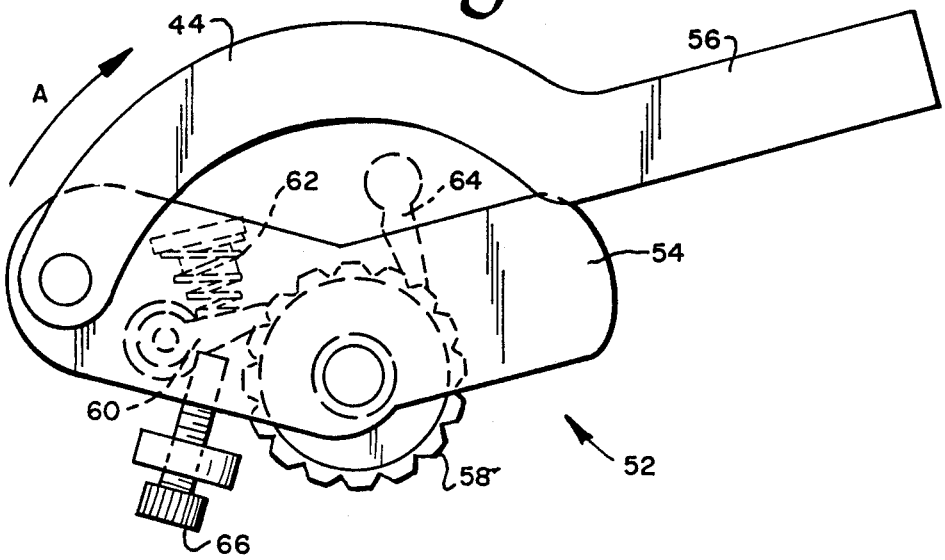

APPARATUS FOR APPLYING TAPE TO PAVEMENT

BACKGROUND OF THE INVENTION

The present invention relates to an apparatus for applying tape and, in particular, to an apparatus for applying tape for marking a paved surface.

While various pavement-marking tape applicators are known, generally, as for example are shown in U.S. Pat. Nos. 3,393,114, and 4,242,173, heretofore, to applicant's knowledge, no pavement marking applicator has been developed which can versatilely selectively apply tape from one, two or more different rolls of tape having different widths with a simple, reliable, and easy to operate advancement mechanism and selectively cut only one, two or more of the tapes being applied so that the particular pavement marking needs of an operator can be met with a single apparatus during a single pavement marking pass.

SUMMARY OF THE INVENTION

Accordingly, it is an object of the present invention to provide a versatile tape apply apparatus. To achieve this object, the tape applicator of the present invention includes a tape advancement initiation device which can selectively advance one, two or more strips of tape mounted thereto and a cutter assembly which can selectively cut one, two or more of the tape strips being applied.

Other objects, features and characteristics of the present invention, as well as the methods of operation and functions of the related elements of the structure, and the combination of parts and economies of manufacture, will become more apparent upon consideration of the following detailed description and the appended claims with reference to the accompanying drawings all of which form a part of this specification, wherein like reference numerals designate corresponding parts in the various figures.

BRIEF DESCRIPTION OF THE DRAWINGS

FIG. 3 is a top plan view partly broken away with some parts omitted for clarity of the apparatus of the invention showing, in particular, the tape feeder assembly;

FIG. 4 is an enlarged elevational view of a portion of the tape feeder assembly of FIG. 2;

DETAILED DESCRIPTION OF THE PRESENTLY PREFERRED EXEMPLARY EMBODIMENT

Figure 1:
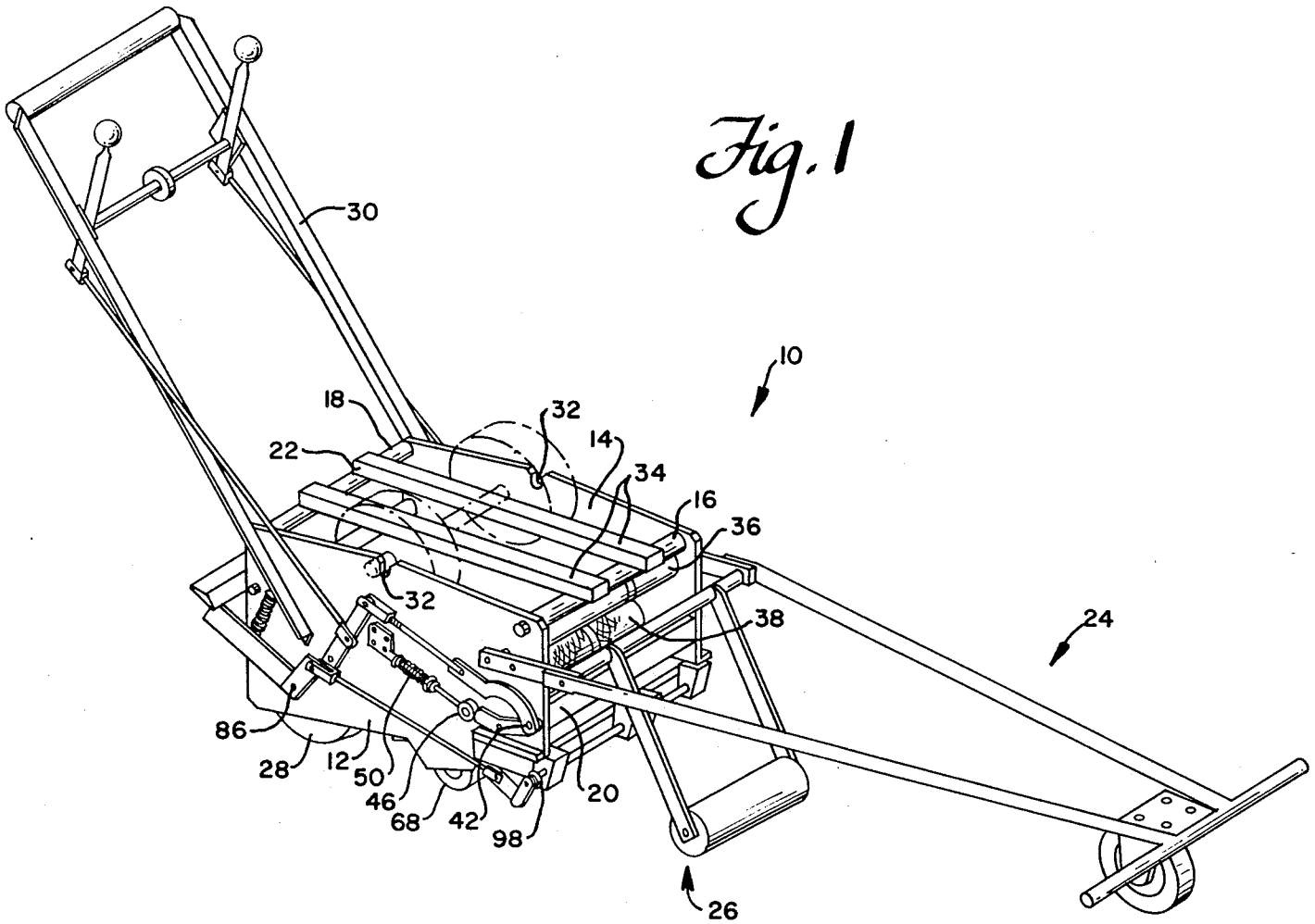
FIG. 1 is a perspective view of a tape applicator assembly formed in accordance with the present invention.

Referring to FIG. 1, the tape applying apparatus 10 of the present invention includes a main frame having first and second side walls 12, 14 front and rear transverse upper support members 16, 18, front and rear lower spacer coupling members 20, 22, a front pointer assembly 24 for guiding the operator, a front supporting roller 26 and rear wheels 28. A handle 30 is attached to the first and second side frames 12, 14 for enabling a user to push the apparatus 10 along a paved surface. Each of the side walls of the frame has an upwardly open groove 32 for receiving a shaft (shown in phantom lines) carrying one, two or three rolls of tape, depending upon the particular needs of the operator. While in the illustrated embodiment only a single uppermost groove 32 is defined on each of the side walls 12, 14 of the frame, it is to be understood that more grooves could be provided for different diameter tape rolls.

Preferably, one or more longitudinally extending bars 34, rods or the like are mounted to and extend between the front and rear transverse support members 16, 18. The bars 34 are spaced apart transversely of the frame so as to provide a desired spacing between adjacent rolls of tape and to maintain the same at such proper positioning during use of the apparatus. While two bars are illustrated in FIG. 1, it is to be understood that the particular number and location of bars depends upon the number and size of rolls of tape. Therefore, for example, one or both of these bars may be eliminated if a wide roll of tape is utilized. In the alternative, spacer clamps or the like could be mounted to the shaft carrying the tape rolls.

As noted above, rolls of tape are mounted to a shaft or the like (not shown) which is laid across the side frame members so as to be disposed in grooves 32 at the top of each side frame. The rolls of tape are free to rotate relative to the shaft and to the side frame as tape is dispensed. The tape is guided from the roll of tape over a tape support bar 36 so that the adhesive surface of the tape faces forwardly of the apparatus. The tape is fed downwardly from the tape support bar so as to pass between first and second rolls 38,40 of the tape feeder assembly.

Figure 2:
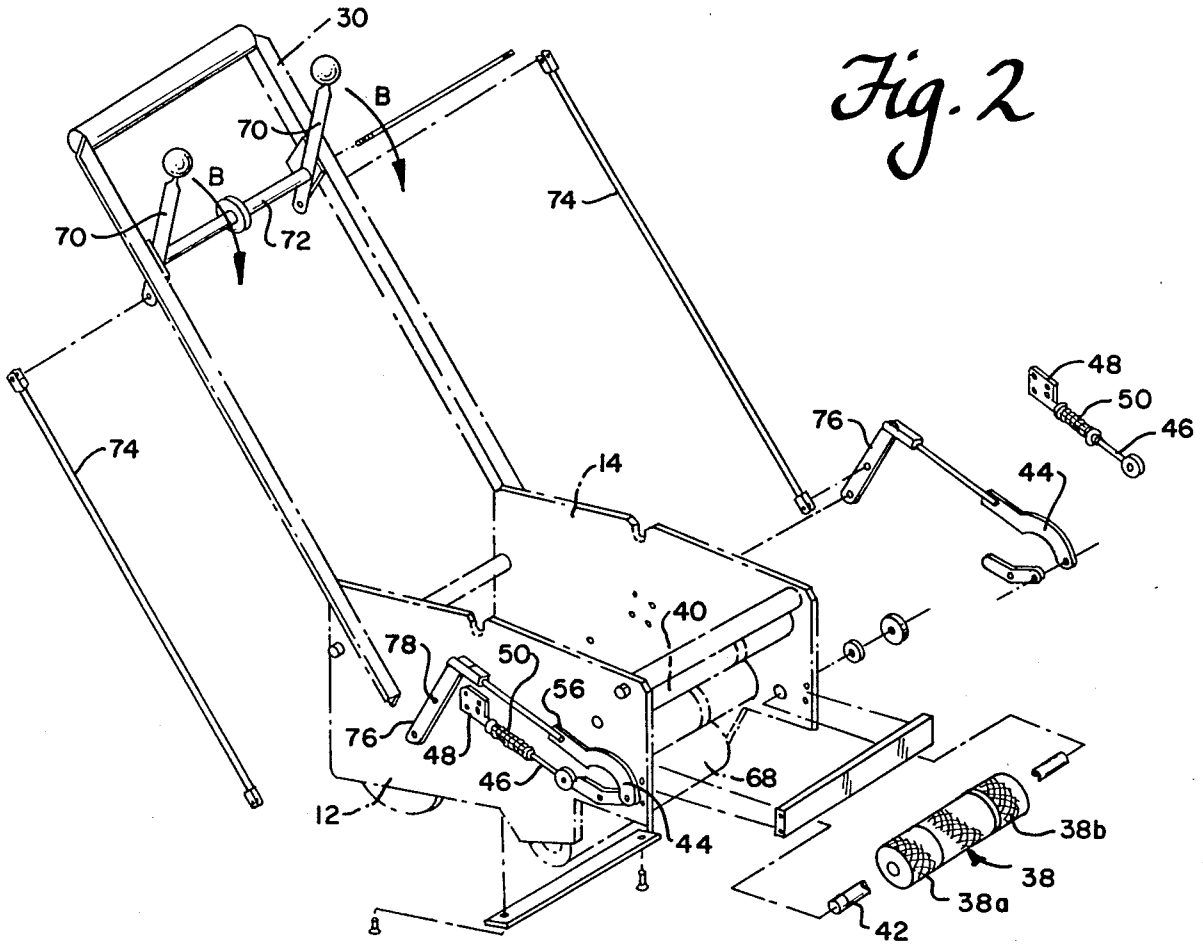
FIG. 2 is an exploded perspective view, partly broken away and with some parts omitted for clarity, showing the tape feeder assembly of the present invention.

The tape feeder assembly, which can be seen most clearly in FIGS. 2, 3 and 4, includes a first knurled surfaced roller 38 which is rotatably mounted to side frames 12, 14 but longitudinally fixed with respect thereto. More particularly, the knurled roller is mounted on a shaft 42 which is mounted to the side frames so as to be fixed transversely and longitudinally with respect to the frames but rotatable about its longitudinal axis. Each longitudinal end of the shaft of the first roller is operatively coupled to a C-shaped lever arm 44 which selectively rotates the roller about its axis, as discussed more fully below. However, the knurled roller cannot slide forwardly or rearwardly relative to the side frames.

As is shown schematically in FIGS. 2 and 3, first roller 38 has spaced knurled sections 38*a*, 38*b* which contact the adhesive side of the tape which passes between first and second rollers 38, 40. Because the surface of the roller is knurled so as to have only spaced contact points with the adhesive surface of the tape, however, adhesive attachment of the tape to the first roller is prevented. Further, in accordance with the most preferred embodiment of the present invention, spaced knurled sections 38*a*, 38*b* correspond to predetermined widths of tape to be applied by the tape applying machine and can be rotated independently of one another by their respective C-shaped lever arms 44. In this manner, a strip of tape from one or more rolls mounted on the tape applying apparatus 10 can be advanced by the tape feeder assembly while another strip of tape extending from another roll mounted to the apparatus is not advanced and thus is not applied to the pavement surface. The manner in which tape is advanced by the tape feeder assembly and which allows such independent advancement of tape will be discussed more fully below.

The second roller 40 of the tape feeder assembly has a smooth surface and is mounted longitudinally behind the knurled roller 38. The smooth roller 40 is mounted so as to be rotatable about its longitudinal axis and is slidable forwardly and rearwardly relative to the side frames 12, 14. More particularly, each end of the smooth roller is mounted to one end of a rod 46 which is slidably mounted at the other end thereof within a housing 48 which is fixed to its respective side frame of apparatus 10. A spring element 50 is mounted intermediate an enlarged head portion of the rod adjacent smooth roller 40 and housing 48. Spring 50 urges rod 46 forwardly out of housing 48 and at the same time tends to urge smooth roller 40 forwardly towards knurled roller 38. Slots defined in the side frame for the smooth roller shaft (not shown in particular) enable this sliding movement. In this manner, the smooth roller is selectively urged into contact with the knurled roller so that a piece of tape depending therebetween will be gripped between the rollers and rotation of the knurled roller will advance the tape, as discussed more fully below.

The manner in which knurled roller 38 is rotated and smooth roller 40 is selectively urged towards the knurled roller will be discussed more particularly now with reference to FIG. 4. A rachet rotating assembly 52 is provided for the knurled roller 38 which includes an obtuse V-shaped member 54 rotatably mounted at a mid or central portion thereof to the shaft 42 of knurled roller 38 and at a forward end thereof is pivotally coupled to C-shaped lever arm 44. C-shaped lever arm 44 has a rearwardly extending actuation arm 56 as described more fully below. The rearward end of the V-shaped member 54 abuts rod 46 and holds it in opposition to the force of spring 50, thus maintaining the rollers in spaced apart relation and allowing the free passage of tape strips(s) therebetween.

A toothed gear element 58 is fixedly mounted to the shaft 42 of knurled roller 38 adjacent obtuse V-shaped member 54. A spring biased pawl 60 is pivotally mounted to V-shaped arm 54 and is urged by spring 62 into the teeth of toothed gear element 58. Further, a stop pawl 64 is mounted to the side frame of the assembly so as to prevent counterclockwise rotation (in the view of FIG. 4) of the knurled roller.

With such a structure, then, when the rearwardly extending actuation arm 56 of the C-shaped lever 44 is pulled to the right in FIG. 4, the C-shaped lever 44 pulls the forward end of obtuse V-shaped member 54 through an arc A due to the pivotal coupling therebetween and rotatable coupling of the mid portion of V-shaped member 54 to the shaft of the knurled roller. Rotation of V-shaped member 54 in this manner forces toothed gear 58, under the influence of the spring biased pawl 60, to rotate clockwise as shown in FIG. 4. A stop screw 66 prevents the spring biased pawl from rotating in a clockwise manner about its pivotal coupling to the obtuse V-shaped member so that rotation of the gear under the influence of the spring biased pawl is insured. Thus, as C-shaped lever 44 is pulled to the right in FIG. 4 and obtuse V-shaped member 54 is rotated about its midpoint, engagement of pawl 60 and toothed gear 58 causes the knurled roller to rotate about its longitudinal axis. At the same time, the the rearward end portion of the obtuse V-shaped member 54 which, as can be seen in FIGS. 1 and 2 and noted above, abuts rod 46 in opposition to spring 50, will tend to move downwardly and clockwise as shown in FIG. 4. Thus the rear end of the V-shaped member 54 will move out of contact with the spring biased rod 46. The rod 46 is then free to move forwardly under the influence of spring 50 and at the same time carry smooth roller 40 forwardly into engagement with the knurled roller. Accordingly, as the knurled roller is rotated, the smooth roller is allowed to move forwardly to abut against the knurled roller and a strip of tape which is depending between the two rollers will be gripped between the smooth roller and the knurled roller. Further rotation of the knurled roller will advance the tape downwardly. Again, the spaced contact due to the knurled surface of the first roller will limit adhesion of the tape thereto.

Following the tape advancement, the rachet assembly is returned to its initiating position by again moving C-shaped lever 44 to the left as shown in FIG. 4 so that the obtuse V-shaped member 54 is rotated in a counterclockwise manner. Because spring biased pawl 60 deflects against the force of spring 62, this pawl rachet will simply move over the toothed surface of gear 58. However, rotation of knurled roller 38 in a counterclockwise direction is prevented by engagement of the stop pawl 64, which is mounted to the side frame, as discussed above, with the gear teeth and because the V-shaped member 54 is rotatably mounted to the knurled roller shaft. In addition, as the obtuse V-shaped member 54 is moved to the position as shown in FIG. 4, the rearwardly extending arm thereof will again contact spring biased rod 46 of smooth roller 40 and will urge the same rearwardly to move the smooth roller 40 out of contact with the knurled roller. This disengages the rollers from the tape after the tape is fed under the tape applying roll 68. The ability to remove this pressure reduces the force needed to unroll the stored tape and eases the operator's effort.

If it is desired to advance the tape by a further amount, then the movement of the C-shaped lever to the right as shown in FIG. 4 is repeated by however many increments are necessary to sufficiently advance the tape.

The amount by which the tape is advanced by rotation of the knurled roller and gripping there against by the smooth roller is determined by the stroke length of the rachet mechanism and the circumference of the knurled roller. Therefore, in order to advance the tape sufficiently so that it can be engaged and pressed against the pavement by the tape applying roll 68, a series of strokes many be required.

The C-shaped lever arm and hence the rachet assembly 52 is activated by a series of pivot arms as shown in FIGS. 1 and 2. More particularly, operator control arms 70 are pivotally coupled to a crossbar 72 of handle 30 and fixedly coupled at opposite ends thereof to downwardly and forwardly extending adjustable rods 74. These rods are in turn pivotally coupled to a brace arm 76 which is pivotally coupled to the side frame at 78. Thus, downward movement of the control arms 70 as activated by the operator causes the rods 74 to be drawn upwardly and rearwardly thereby pivoting the brace arm 76 about pivot point 78. The opposite end of the brace arm pulls rearwardly on the actuation arm 56 of the C-shaped lever 44 which is pivotally coupled thereto. Therefore, downward movement of the control arms 70 as shown by the arrow B in FIG. 1 will effect a rearward pulling on the C-shaped lever 44 and thus initiate the rotation of knurled roller 38 and will pull obtuse V-shaped member 54 through arc A.

Figure 6:
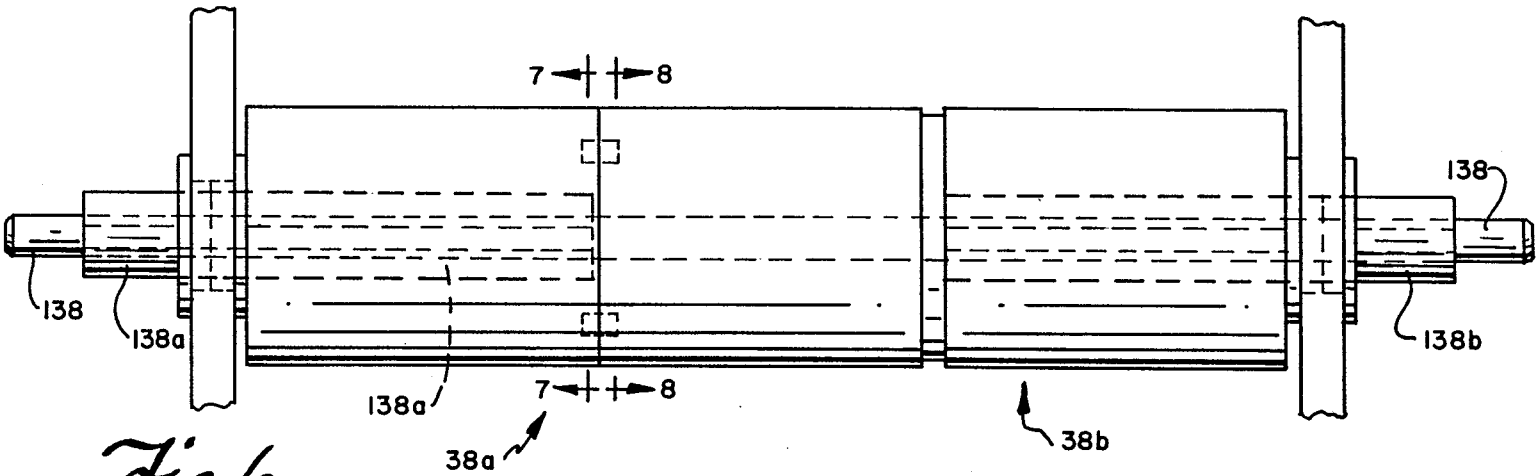
FIG. 6 is an elevational view of a knurled roller provided in accordance with the invention.
Figure 8:
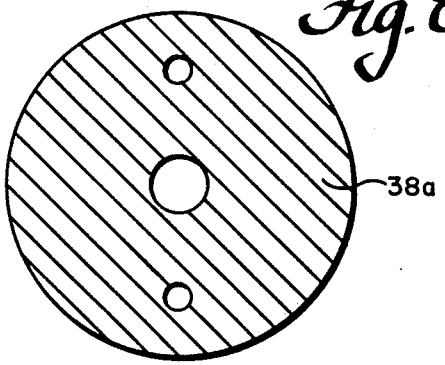
FIG. 8 is a view along line 8—8 of FIG. 6.
Figure 7:
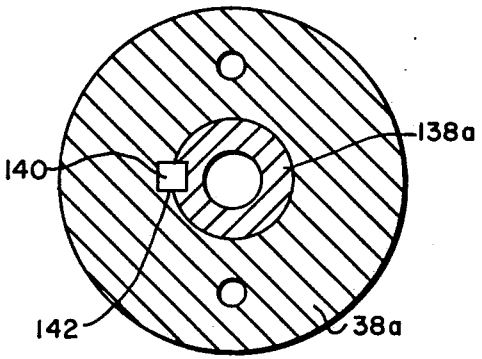
FIG. 7 is a view along line 7—7 of FIG. 6.

As was noted above, in the most preferred embodiment, knurled roller 38 includes first and second portions 38*a*, 38*b* which are rotatable independently of one another so that tape on one side of the apparatus can be selectively advanced independently of tape on the other side of the apparatus. To achieve this object, each portion of the knurled roller is selectively rotated by a respective operator control 70. For example, referring to FIGS. 6–8, downward movement of the operator control knob provided on the right of the apparatus, as seen from the operator's position, will rotate a hub 138*a* which is rotatably mounted to knurled roller shaft 138. Because hub 138*a* is engaged with roller 38*a* by, for example, a key 140 and groove 142 interfitment, roller 38*a* will rotate with hub 138*a* relative to roller 38*b* and shaft 138. Thus, through the simultaneous forward urging of the smooth roller, tape mounted on the right hand side of the apparatus and depending between the knurled roller and the smooth roller will be gripped and advanced independently of other strips of tape. Similarly downward movement of the left hand control 70 will rotate hub 138*b* and roller 38*b* engaged therewith. Of course, in certain applications it will be necessary to advance tape from two or more rolls simultaneously depending upon the number of rolls mounted to the apparatus. In such a case, the control arms can be operated simultaneously and/or coupled together, or the knurled roller portions 38*a* and 38*b* can be coupled together so as to rotate as a unitary structure whereby all the tape depending between the knurled roller 38 and the smooth roller can be simultaneously fed towards the tape applying roller of the apparatus.

Advancement of multiple tapes can be best controlled by dividing the smooth roller into portions corresponding in dimension to the separate portions of the knurled roller so that solely a portion of the smooth roller corresponding to the rotating knurled portion will be allowed to move into contact therewith and thus advance the tape therebetween.

The cutter assembly of the present invention will now be described with reference to FIG. 5. The cutter assembly is preferably operated by foot pedals 80 which are mounted by springs 82 to the left and to the right side frames so that the pedals 80 automatically return to a non-cutting position after use. The pedals themselves are rigidly connected to forwardly extending L-shaped members 84 which are pivotally coupled to the side frames at 86. The remote end of each short arm 88 of the L is pivotally coupled to a joint arm 90 having pivotal coupling brackets 92 at each thereof and a threaded central rod which can be rotated so as to vary the overall length of the joint arm 90 in accordance with the desired cutting stroke length as will be come more apparent below. Adjustable rods 74 of the tapefeeder actuation system have a structure similar to that of joint arm 90.

The distal end bracket of the joint arm is pivotally coupled to a V-shaped arm element 94 mounted forwardly of the apparatus and has a central pivot coupling 96. A distalmost end of the V-shaped arm is fixedly coupled at 98 to a front cutting blade support structure 100 which is fixedly mounted to the side frame members of the apparatus. The cutting blade assembly 110 itself is coupled to the pivotal central portion of the V-shaped arm 94 and is slidable relative to the fixed support structure 100. More particularly, as the pedal 80 is depressed, L-shaped member 84 pivots about pivot point 86 so that the short arm 88 moves upwardly and rearwardly. This movement of the short arm 88 in turn pulls joint arm 90 rearwardly. This in turn pulls the rear arm of the V-shaped element 94 rearwardly. Because of the pivot mounting of the forward end of the V-arm 94 to the stationary support structure 100, the V-shaped arm 94 tends to flatten and the central portion moves upwardly and rearwardly as the rearward end of the V-shaped arm 94 is pulled by joint arm 93. Thus, the blade assembly 110, coupled to the central portion 96 of V-shaped arm 94 is pulled rearwardly and upwardly towards tape being dispensed by the apparatus. However, the rearward extending shelf portion 112 of the support structure 100 ensures that the blade assembly 110 will move substantially rearwardly rather than upwardly under the influence of the pivoting V-shaped arm 94.

Figure 5:
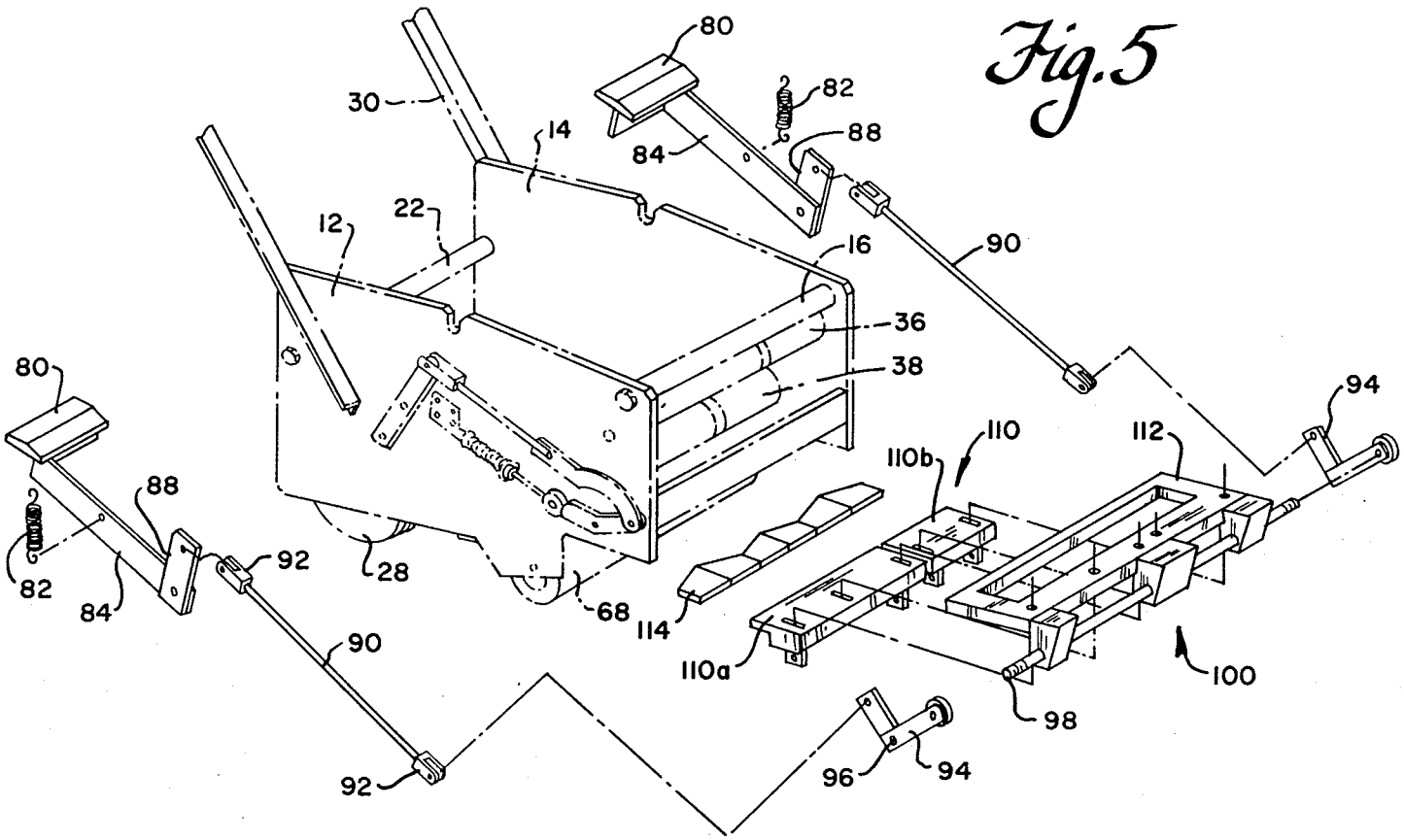
FIG. 5 is an exploded perspective view partly broken away, partly in phantom, and with some parts omitted for clarity, showing the cutter assembly formed in accordance with the present invention.

As can be further seen in FIG. 5, the blade assembly 110 is preferably provided as first and second blade cutting elements 110*a*, 110*b*, the first of which includes two sets of chevron shaped cutters 114 and the second of which has one set of cutters 114. One pedal 80 controls each of the sides of the cutter. Accordingly, selectively pushing one of the pedals will effect cutting of a particular strip of tape being dispensed by the apparatus. Thus, the cutters are preferably mounted so as to correspond to the separately knurled portions of the knurled roller so that the knurled roller can advance one tape but not another and the operator can selectively cut one tape but not the other. However, if a given operation requires that tapes be simultaneously cut, both pedals can be depressed or the pedals can be structurally interconnected to effect simultaneous cutting. In the alternative, the blade elements can be interconnected so as to operate together under the influence of a single pedal.

While the invention has been described in connection with what is presently considered to be the most practical and preferred embodiment, it is to be understood that the invention is not limited to the disclosed embodiment, but, on the contrary, it is intended to cover various modifications and equivalent arrangements included within the spirit and scope of the appended claims.

What is claimed is:

1. An apparatus for applying tape to a paved surface comprising:

a main frame having at least first and second wheel means for advancing said main frame along a paved surface to be marked;

means for rotatably carrying at least one roll of tape to be applied;

a tape applying roller mounted for pressing tape dispensed from said at least one roll of tape against the paved surface;

means for selectively advancing tape from at least one of said at least one roll of tape towards the paved surface, said tape advancing means including first and second rollers, at least one of said rollers being mounted for selective movement into engagement with the other of said rollers and means for rotating at least one of said rollers at least when said rollers are in engagement whereby a strip of tape depending between said rollers will be advanced by rotation of said at least one roller, said means for rotating at least one of said rollers comprising a ratchet and pawl assembly operatively coupled to a shaft of said roller so as to selectively rotate said roller about the longitudinal axis thereof in one direction while prohibiting rotation in the opposite direction; and means for cutting a strip of tape extending at least between said tape advancing means and said tape applying roller.

2. An apparatus as in claim 1, wherein said at least one of said rollers which is rotated includes at least first and second roller sections selectively independently rotatable by a respective ratchet and pawl assembly and wherein first and second control arms are provided for selectively operating each said ratchet and pawl assembly whereby one portion of said advancing means will advance tape independently of the remaining portion of the advancing means.

3. An apparatus as in claim 1, wherein one of said rollers is slidable longitudinally relative to said main frame by means of a spring biased rod coupled to a longitudinal shaft of said one of said rollers so as to selectively move into engagement with the other of said rollers.

4. An apparatus as in claim 3, wherein said ratchet and pawl assembly is operatively coupled to said spring biased rod such that operation of said ratchet and pawl assembly to rotate said at least one of said rollers causes said spring biased rod to urge said at least one of said rollers into engagement with the other roller.

5. An apparatus as in claim 3, wherein said at least one of said rollers which is rotated includes at least first and second roller sections selectively independently rotatable by a respective ratchet and pawl assembly and wherein first and second control arms are provided for selectively operating each said ratchet and pawl assembly whereby one portion of said advancing means will advance tape independently of the remaining portion of the advancing means.

6. An apparatus as in claim 1, wherein said cutting means comprises a plurality of blade members mounted for sliding movement along a portion of the longitudinal axis of said apparatus so as to engage and cut tape extending between said advancing means and said tape applying roller.

7. An apparatus as in claim 6, wherein said cutting means includes first and second cutting blade assemblies, selectively independently operable by means of a respective pedal, each said pedal being spring mounted to said main frame so as to be biased into an inoperative position.

* * * * *